US006963716B2

(12) United States Patent
Kobayashi et al.

(10) Patent No.: US 6,963,716 B2
(45) Date of Patent: Nov. 8, 2005

(54) IMAGE FORMING APPARATUS FEATURING A RESISTANCE RELATIONSHIP BETWEEN AN IMAGE BEARING MEMBER AND A TRANSFER MEMBER

(75) Inventors: Tatsuya Kobayashi, Shizuoka-ken (JP); Naoki Enomoto, Toride (JP); Takashi Shibuya, Shizuoka-ken (JP); Masaru Shimura, Numazu (JP); Seiji Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/664,880

(22) Filed: Sep. 22, 2003

(65) Prior Publication Data

US 2004/0126155 A1 Jul. 1, 2004

(30) Foreign Application Priority Data

Sep. 24, 2002 (JP) ..... 2002-277237

(51) Int. Cl.[7] ..... G03G 15/16
(52) U.S. Cl. ..... 399/302; 399/308
(58) Field of Search ..... 399/302, 308, 399/303, 313, 66, 44; 430/126

(56) References Cited

U.S. PATENT DOCUMENTS

| | | | | |
|---|---|---|---|---|
| 5,809,387 | A | 9/1998 | Takeuchi et al. | 399/302 |
| 5,915,145 | A | 6/1999 | Shimura et al. | 399/66 |
| 5,953,572 | A * | 9/1999 | Takeuchi et al. | 399/302 |
| 6,070,047 | A * | 5/2000 | Ichinose et al. | 399/308 X |
| 6,173,135 | B1 | 1/2001 | Yuminamochi et al. | 399/66 |
| 6,175,712 | B1 * | 1/2001 | Masuda et al. | 399/302 |
| 6,477,339 | B1 * | 11/2002 | Yano et al. | 399/302 X |
| 6,529,695 | B2 * | 3/2003 | Katayanagi et al. | 399/302 X |
| 6,556,797 | B1 | 4/2003 | Nishigaki et al. | 399/130 |
| 2003/0063921 | A1 | 4/2003 | Saito et al. | 399/121 |
| 2003/0077091 | A1 * | 4/2003 | Takahata et al. | 399/302 |
| 2003/0128999 | A1 * | 7/2003 | Bessho et al. | 399/302 X |

FOREIGN PATENT DOCUMENTS

| | | | |
|---|---|---|---|
| JP | 10-240042 | * | 9/1998 |
| JP | 11-167294 | | 6/1999 |
| JP | 2000-056587 | * | 2/2000 |
| JP | 2001-324883 | | 11/2001 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a first image bearing member for bearing a toner image; a second image bearing member for bearing the toner image; a transfer member opposed to the first image bearing member with the second image bearing member therebetween, wherein a voltage is applied to the transfer member to transfer the toner image from the first image bearing member onto the second image bearing member, and wherein a resistance Rt of the transfer member and a resistance Rb of the second image bearing member satisfy Rt/Rb≧1.0.

6 Claims, 11 Drawing Sheets

| | | RESISTANCE OF INTERMEDIARY TRANSFER BELT Rb (Ω) | | | | | | | | |
|---|---|---|---|---|---|---|---|---|---|---|
| | | $1\times10^{6}$ | $2\times10^{6}$ | $1\times10^{7}$ | $2\times10^{7}$ | $1\times10^{8}$ | $2\times10^{8}$ | $1\times10^{9}$ | $2\times10^{9}$ | $2\times10^{10}$ |
| RESISTANCE OF 1RY TRANSFER ROLLER Rt (Ω) | $1\times10^{6}$ | △ | × | × | × | × | × | × | ×× | ×× |
| | $2\times10^{6}$ | ○ | △ | × | × | × | × | × | ×× | ×× |
| | $1\times10^{7}$ | ○ | ○ | △ | × | × | × | × | ×× | ×× |
| | $2\times10^{7}$ | ○ | ○ | ○ | △ | × | × | × | ×× | ×× |
| | $1\times10^{8}$ | ○ | ○ | ○ | ○ | △ | × | × | ×× | ×× |
| | $2\times10^{8}$ | ○ | ○ | ○ | ○ | ○ | △ | × | ×× | ×× |
| | $1\times10^{9}$ | ○ | ○ | ○ | ○ | ○ | ○ | △ | ×× | ×× |
| | $2\times10^{9}$ | ○ | ○ | ○ | ○ | ○ | ○ | ○ | ×× | ×× |
| | $1\times10^{10}$ | – | – | – | – | – | – | – | ××– | ××– |
| | $2\times10^{10}$ | – | – | – | – | – | – | – | ××– | ××– |

FIG.4

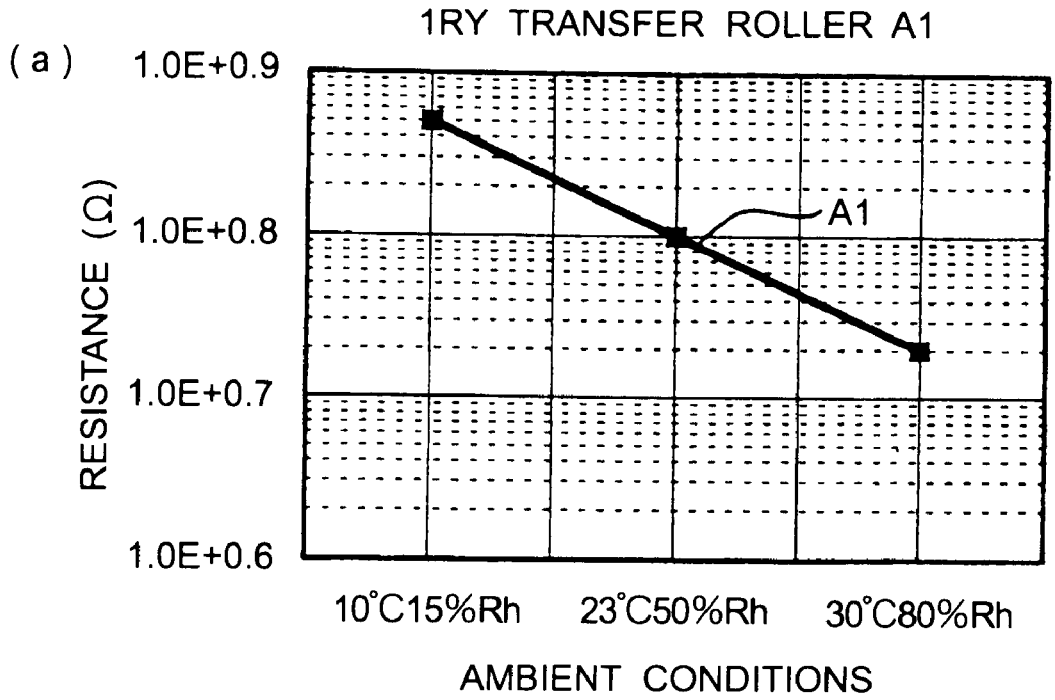
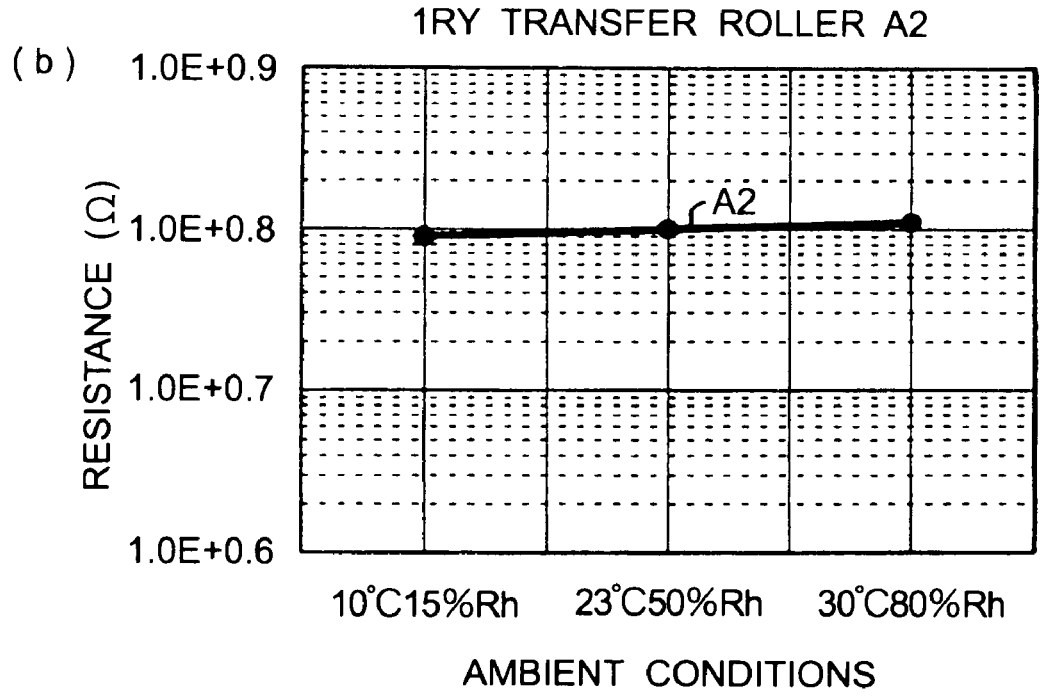
FIG.5

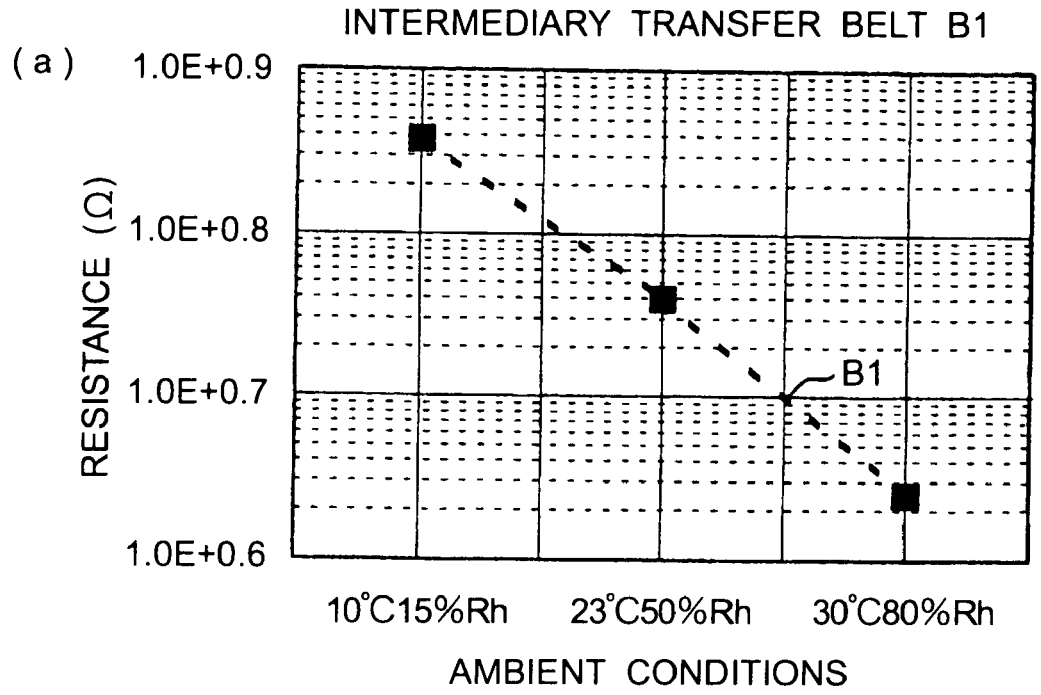
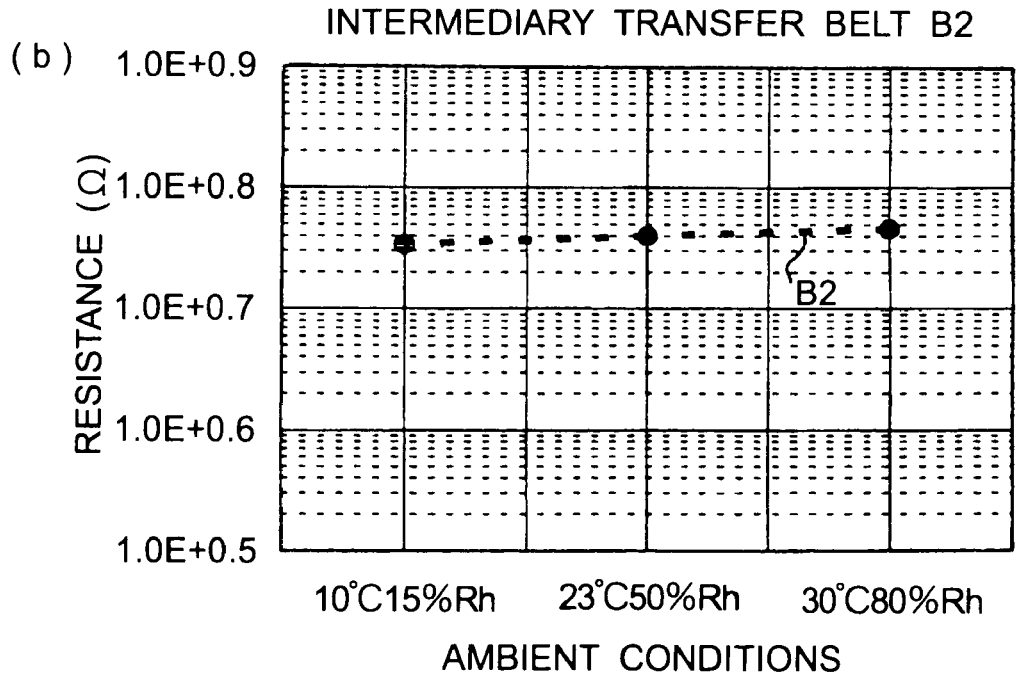
FIG.6

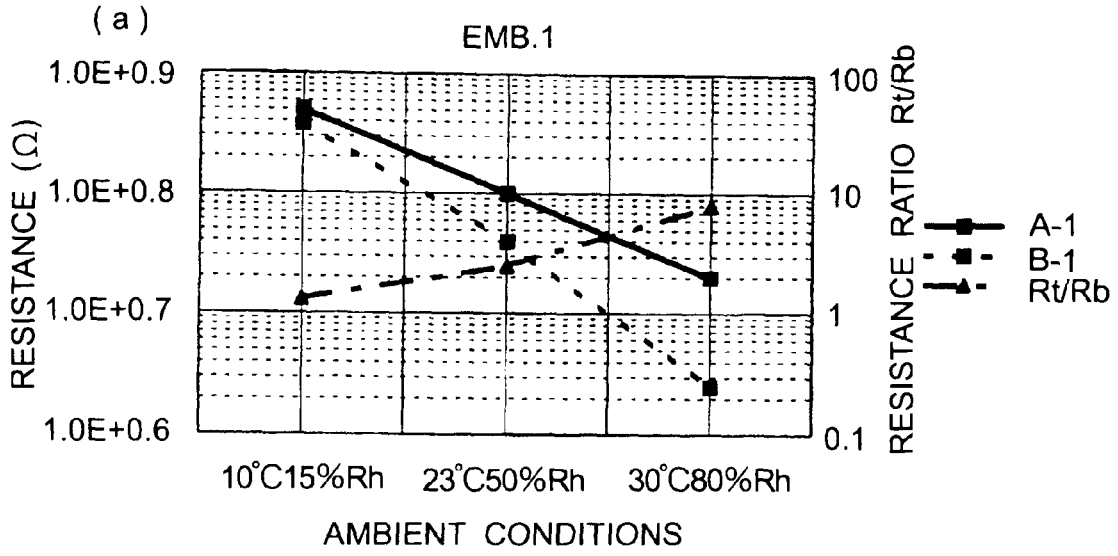
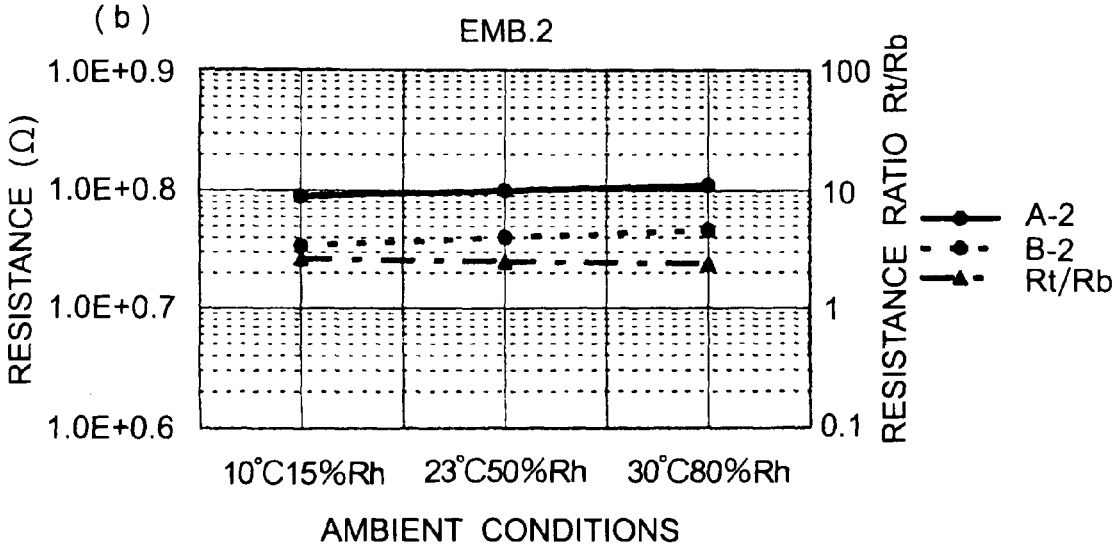
FIG.7

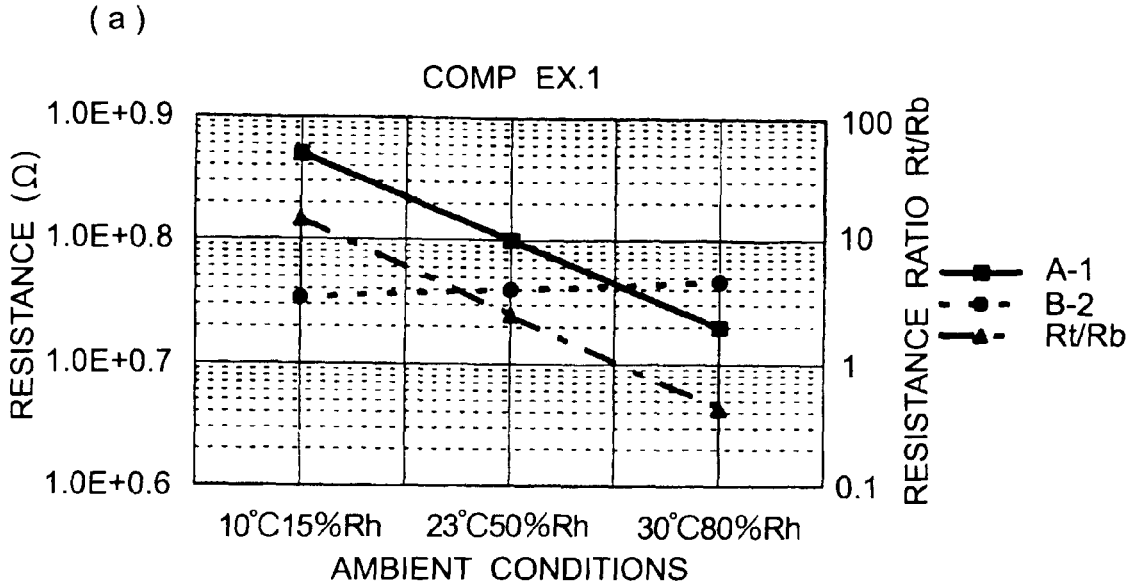
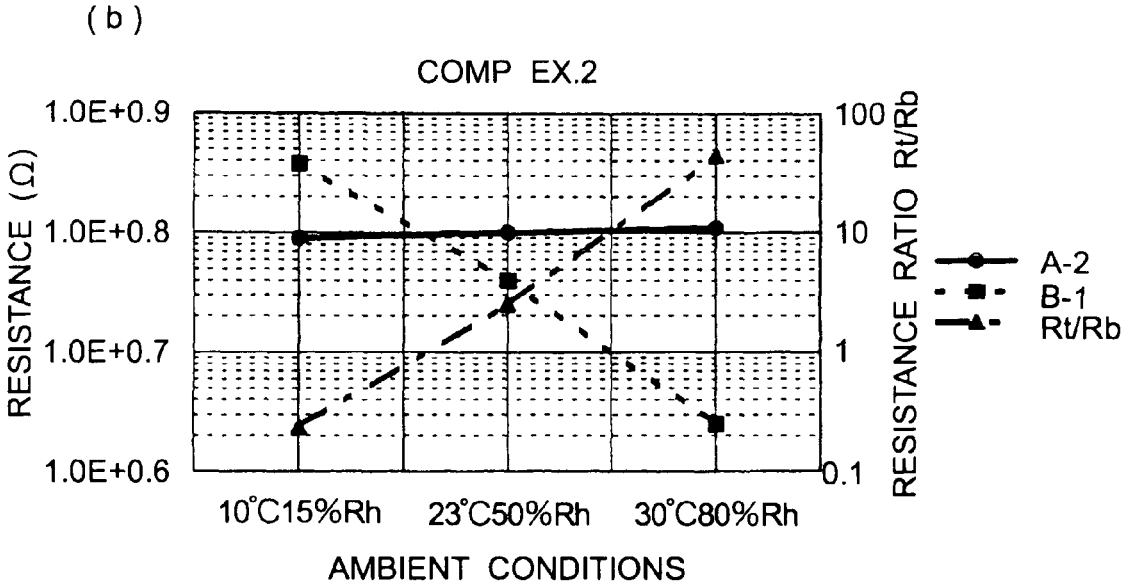
FIG 8

| RESISTANCE OF 1RY TRANSFER ROLLER Rt (Ω) | RESISTANCE OF INTERMEDIARY TRANSFER BELT Rb (Ω) | | | | | | | | |
|---|---|---|---|---|---|---|---|---|---|
| | $1\times10^{6}$ | $2\times10^{6}$ | $1\times10^{7}$ | $2\times10^{7}$ | $1\times10^{8}$ | $2\times10^{8}$ | $1\times10^{9}$ | $2\times10^{9}$ | $2\times10^{10}$ |
| $1\times10^{6}$ | ☆ | × | × | × | × | × | × | ×× | ×× |
| $2\times10^{6}$ | ☆ | △ | × | × | × | × | × | ×× | ×× |
| $1\times10^{7}$ | ☆ | ○ | △ | × | × | × | × | ×× | ×× |
| $2\times10^{7}$ | ☆ | ○ | ○ | △ | × | × | × | ×× | ×× |
| $1\times10^{8}$ | ☆ | ○ | ○ | ○ | △ | × | × | ×× | ×× |
| $2\times10^{8}$ | ☆ | ○ | ○ | ○ | ○ | △ | × | ×× | ×× |
| $1\times10^{9}$ | ☆ | ○ | ○ | ○ | ○ | ○ | △ | ×× | ×× |
| $2\times10^{9}$ | ☆ | ○ | ○ | ○ | ○ | ○ | ○ | ×× | ×× |
| $1\times10^{10}$ | ☆ | – | – | – | – | – | – | ××– | ××– |
| $2\times10^{10}$ | ☆ | – | – | – | – | – | – | ××– | ××– |

FIG. 10

IMAGE FORMING APPARATUS FEATURING A RESISTANCE RELATIONSHIP BETWEEN AN IMAGE BEARING MEMBER AND A TRANSFER MEMBER

FIELD OF THE INVENTION AND RELATED ART

The present invention relates to an image forming apparatus of an electrophotographic type using an image bearing member, such as a laser beam printer, a copying machine, a facsimile or the like.

Various types of electrophotographic image forming apparatus are known in which an electrostatic latent image is formed on an electrostatic latent image bearing member such as a photosensitive drum and is developed with toner into a toner image, which is in turn fixed on a transfer material. Among them, there is a type wherein a toner image is transferred (primary transfer) onto an intermediary transfer member from the electrostatic latent image bearing member, and then it is transferred (secondary transfer) onto a transfer material. This is advantageous in that apparatus is usable with various types of transfer materials. Various types of color image forming apparatus have been proposed, wherein different color images are superimposed.

Referring first to FIG. 11, a conventional image forming apparatus will be described. In this Figure, a surface of a photosensitive drum 101 which is an electrostatic latent image bearing member is electrically and uniformly charged by a roller charger 102 (charger) (primary charging), and thereafter, it is exposed to image light by an exposure device 103 so that electrostatic latent image is formed thereon. The electrostatic latent image is developed by a plurality of revolvable developing devices 104*a–d* supported by supporting member 105 into toner images, which are sequentially and superimposingly transferred (primary transfer) onto an intermediary transfer belt 161 which is an image bearing member of the intermediary transfer unit 106. A primary transfer roller 165 is arranged against photosensitive drum 101 with an intermediary transfer belt therebetween. The color toner images formed on the intermediary transfer belt 161 are all together transferred onto the transfer material (sheet) (secondary transfer) by the secondary transfer roller 166, and are fused and fixed by a fixing device 108. The toner remaining on the photosensitive drum 101 and on the intermediary transfer belt 161 is removed by cleaning devices 107, 167, respectively.

However, with such a conventional apparatus, there is a problem that abnormal electric discharge occurs due to local current concentration at the position of the primary transfer (contact portion between the photosensitive drum 101 and the intermediary transfer belt 161) where the intermediary transfer belt 161 is separated from the photosensitive drum 101 surface, with the result of disturbance to the image.

SUMMARY OF THE INVENTION

Accordingly, it is a principal object of the present invention to provide an image forming apparatus wherein the disturbance of the image due to the abnormal electric discharge between the first image bearing member and the second image bearing member.

It is another object of the present invention to provide an image forming apparatus includes a first image bearing member for bearing a toner image; a second image bearing member for bearing the toner image; a transfer member opposed to said first image bearing member with said second image bearing member therebetween, wherein a voltage is applied to said transfer member to transfer the toner image from said first image bearing member on the second image bearing member, and wherein a resistance Rt of said transfer member and a resistance Rb of said second image bearing member satisfy $Rt/Rb \geqq 1.0$.

It is a further object of the present invention to provide an image forming apparatus includes an image bearing member for bearing a toner image; an intermediary transfer member for bearing the toner image; a transfer member opposed to said image bearing member with said intermediary transfer member therebetween, wherein a voltage is applied to said transfer member to transfer the toner image from said image bearing member onto the intermediary transfer member, and wherein said intermediary transfer member and said transfer member have ionic electroconductivities.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 shows results of investigation of abnormal electric discharge with different resistance values of the intermediary transfer belt and the primary transfer roller.

FIGS. 5(*a*) and 5(*b*) show resistance values of the primary transfer roller under different ambient conditions.

FIGS. 6(*a*) and 6(*b*) show resistance values of the intermediary transfer belt under different ambient conditions.

FIGS. 7(*a*) and 7(*b*) show a relation between the ambience resistance property and resistance ratio Rt/Rb.

FIGS. 8(*a*) and 8(*b*) show a relation between the ambience resistance property and resistance ratio Rt/Rb.

FIG. 10 shows results of investigation of abnormal electric discharge with different resistance values of the intermediary transfer belt and the primary transfer roller.

DESCRIPTION OF THE PREFERRED EMBODIMENT

Figure 1:
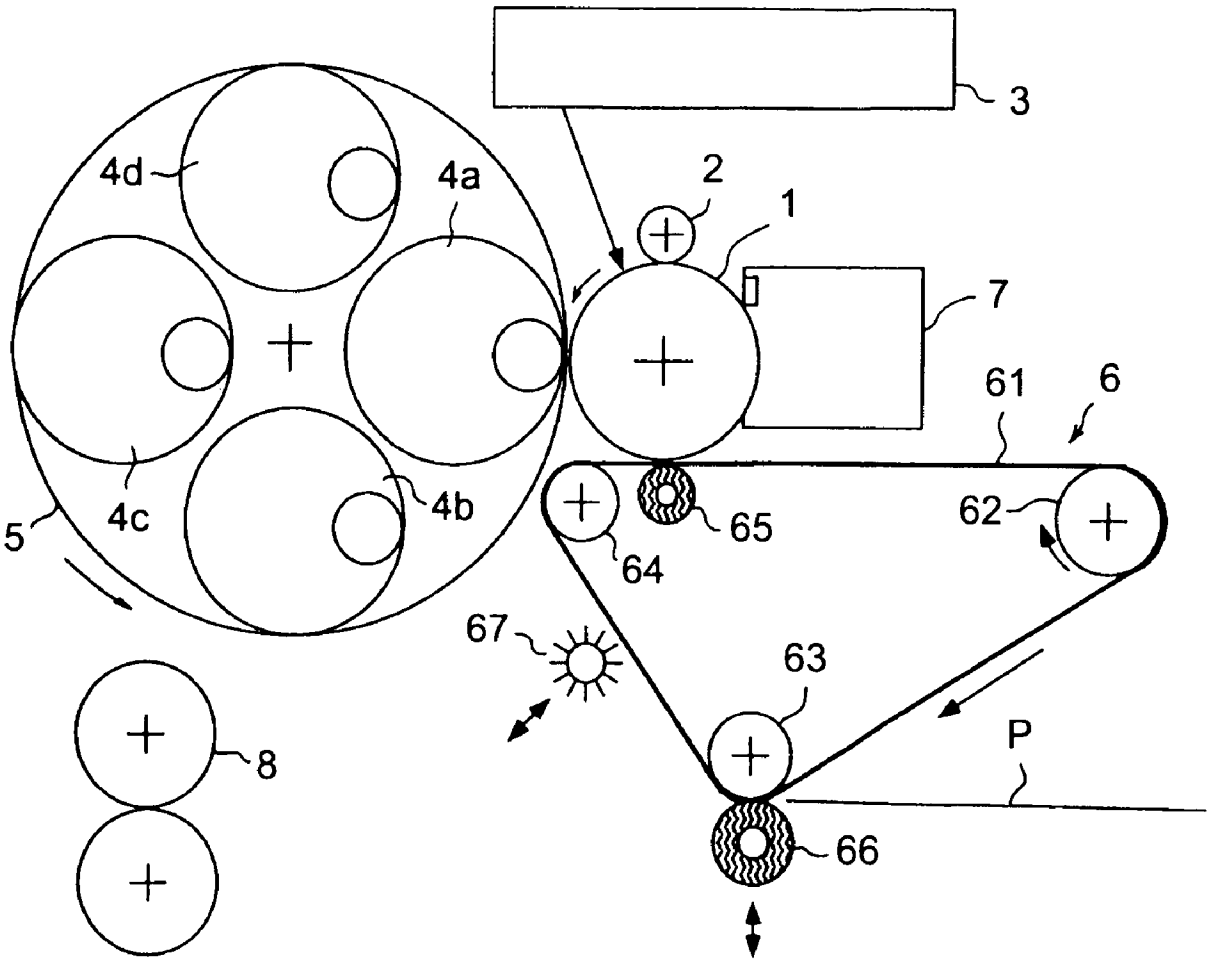
FIG. 1 shows an image forming apparatus according to an embodiment of the present invention.
Figure 2:
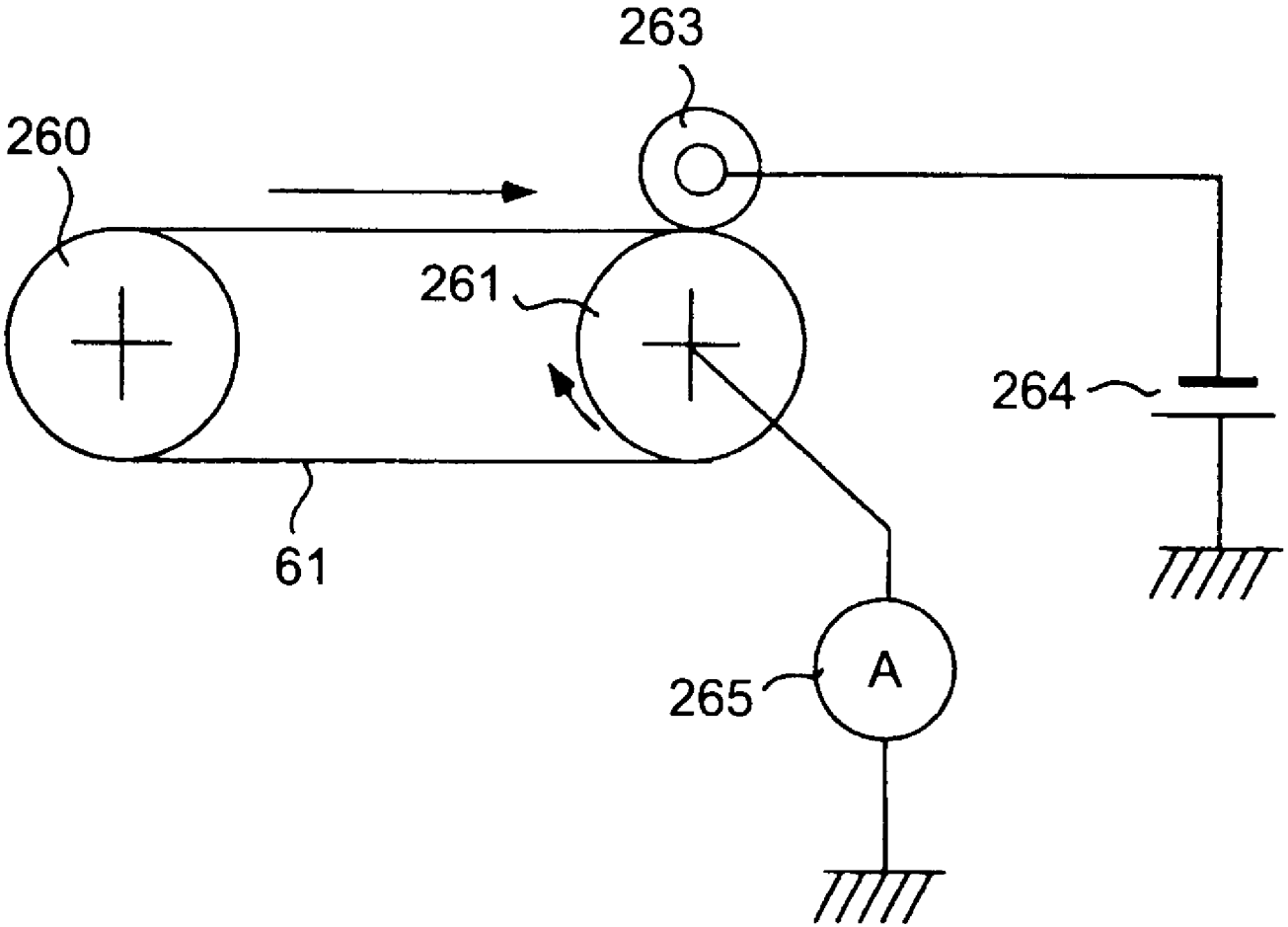
FIG. 2 illustrates a device for measuring a resistance value of the intermediary transfer belt.
Figure 3:
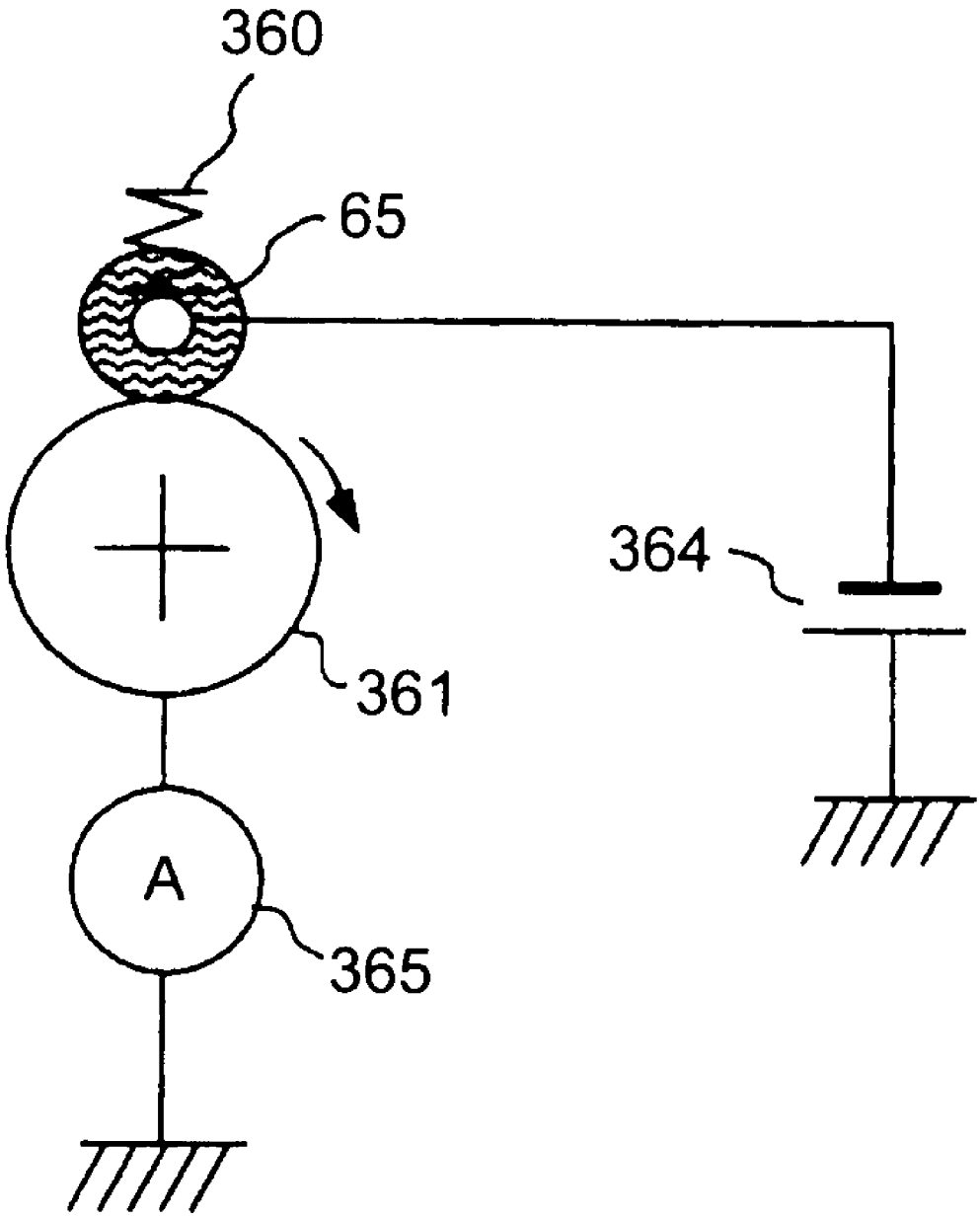
FIG. 3 illustrates an apparatus for measuring a resistance value of a primary transfer roller.

The description will be made as to an image forming apparatus according to a first embodiment of the present invention. FIG. 1 shows a general arrangement of the image forming apparatus. FIG. 2 illustrates a device for measuring a resistance value of the intermediary transfer belt. FIG. 3 illustrates an apparatus for measuring a resistance value of a primary transfer roller. FIG. 4 shows results of investigation of abnormal electric discharge with different resistance values of the intermediary transfer belt and the primary transfer roller.

The image forming apparatus shown in FIG. 1 is an example of image forming apparatus using an intermediary transfer belt as the second image bearing member. A photosensitive drum 1 (electrostatic latent image bearing member) is a first image bearing member comprising an aluminum cylinder and a photoconductor of organic photosensitive member (OPC) or A-Si, CdS, Se or the like applied on the outer surface. The photosensitive drum 1 is driven in the direction of an arrow by an unshown driving means, and is charged uniformly to a predetermined potential by a charging roller 2. Image light modulated in accordance with a signal corresponding to a yellow image pattern is projected onto the photosensitive drum 1 by an exposure device 3 so that latent image is formed thereon. With rotation of the photosensitive drum 1 in the direction of the arrow, a developing device 4*a* containing yellow toner among developing devices 4*a–d* supported on a supporting member 5 is faced to the photosensitive drum 1 by revolution of the supporting member 5, and the thus selected developing device 4*a* develops the latent image into a visualized image. The toner image thus developed is transferred onto an intermediary transfer belt 61 (image bearing member).

The intermediary transfer belt 61 is a monolayer belt of an electroconductive material comprising as the base material thermoplastic resin material such as a blend of PC (polybarbonate resin material No.21), PVDF (polyvinylidene fluoride resin material), polyalkylenetele resin material, PC/PAT (polyalkyleneterephthalate resin material), a blend of pTFE (ethyleneterrafluoroethylene copolymer resin material)/PC, ETFE/PAT, PC/PAT. The intermediary transfer belt 61 is trained and stretched around three rollers, namely, a driving roller 62, an opposing roller 63 and a tension roller 64. The driving roller 62 is rotated by an unshown motor in the direction indicated by an arrow in the Figure, by which the transfer belt 61 is rotated in the direction indicated by another arrow.

The primary transfer roller 65 (first transfer member) is provided with an electroconductive sponge layer on a shaft thereof, and is urged to the photosensitive drum 1 with an intermediary transfer belt 61 therebetween. The primary transfer roller 65 is supplied with a bias voltage from an unshown high voltage source, and the toner image on the photosensitive drum 1 is transferred onto the intermediary transfer belt 61. The intermediary transfer belt 61, the driving roller 62, the opposing roller 63, the tension roller 64, the primary transfer roller 65 or the like constitutes an intermediary transfer unit 6. The above-described process is carried out for the magenta color, the cyan color and the black, a toner image of different colors is formed on the intermediary transfer belt 61.

When a four color toner image is transferred onto the intermediary transfer belt 61, a recording material in the form of a sheet P (transfer material) is fed in synchronism with the intermediary transfer belt 61, and a secondary transfer roller 66 (second transfer member) having the structure similar to the primary transfer roller 65 is urged to the intermediary transfer belt 61 with the sheet P therebetween. By application of a bias voltage from an unshown high voltage source, the four color toner image is all together transferred onto the sheet P. The sheet P now having the transferred four-color toner image is pressed and heated by the fixing device 8 so that four-color toner image is fused and fixed into a permanent color image.

The untransferred toner remaining on the photosensitive drum 1 is removed by blade means of a cleaning device 7. The untransferred toner on the intermediary transfer belt 61 is also removed by furbrush, web or the like of a cleaning device 67.

The investigations of the inventors have revealed a cause of an image disturbance attributable to abnormal electric discharge due to local current concentration at the position of the primary transfer (contact portion between the photosensitive drum 101 and the intermediary transfer belt 161) where the intermediary transfer belt 161 is separated from the photosensitive drum 101 surface, with the result of disturbance to the image.

That is, the image pattern is influential. The potential pattern corresponding to a half-tone image having been subjected to a halftone dot process, lateral line images and vertical line images have the same distribution as the image pattern, and the potential difference in the distribution is conducive to a transferring current concentration. The pattern with which the abnormal electric discharge most hardly occurs is a solid image in which the potential of the photosensitive drum is uniform. It has been found that abnormal electric discharge is related with a ratio Rt/Rb, where Rt is a resistance of the primary transfer roller, and Rb is a resistance of the intermediary transfer belt.

When the resistance of the intermediary transfer belt is to high, the abnormal electric discharge occurs irrespective of the image pattern under a low temperature and low humidity ambience.

The abnormal electric discharge is related with the resistance Rb of the intermediary transfer belt, and the problem can be avoided by not using an extremely high resistance value. Irrespective of dependency on the image pattern, the cause is commonly the local transferring current concentration at the time of separation of the intermediary transfer belt from the photosensitive drum at the primary transfer portion.

The description will be made as to a method of measuring the resistance Rb of the intermediary transfer belt 61 and the resistance Rt of the transfer roller 65. As a method for measuring the resistance of a sheet-like member, there is a method using a probe described in JIS method K6911, for example. However, in this invention, a method shown in FIGS. 2 and 3 is used since the resistances of the sheet-like intermediary transfer belt 61 and the primary transfer roller 65 which is a roller and since the resistances can be measured simply without breaking the object.

FIG. 2 shows the device for measuring the resistance of the intermediary transfer belt 61. The intermediary transfer belt 61 is stretched between the two rollers, namely the roller 260 and the roller 261. By rotation of the roller 261 in the direction indicated by the arrow in the Figure, the intermediary transfer belt 61 is rotated in the direction indicated by another arrow. The electroconductive roller 263 is supplied with a bias voltage of a voltage source 264, and the roller 261 around which the intermediary transfer belt 61 is trained is pressed by the pressing member. The roller 261 has a surface layer of electroconductive metal or a surface layer of electroconductive rubber in order to stabilize filing of the intermediary transfer belt 61, and is electrically grounded through an ammeter 265.

In the measuring device, it is desirable that various parameters are substantially the same as with the actual image forming apparatus. More specifically, the width, the moving speed of the intermediary transfer belt 61, the width of the electroconductive roller 263 and width of the primary transfer roller 65, the value of the bias voltage supply from the voltage source 264 and the like are equivalent to the values in the actual image forming apparatus.

FIG. 3 shows a device of measuring the resistance of the primary transfer roller 65. The primary transfer roller 65 is pressed against the metal roller 361 by pressing a core metal provided at the end of the transfer roller 65 by a pressing member 360. The metal roller 361 is rotated in the direction indicated by an arrow in the Figure by an unshown driving means, and the primary transfer roller 65 is driven by the rotation of the metal roller 361. The primary transfer roller 65 is supplied with a predetermined bias voltage from the voltage source 364. The metal roller 361 is electrically grounded through an ammeter 365.

In this device, too, various parameters are preferably substantially the same as with the actual image forming apparatus. More specifically, the rotational speed of the primary transfer roller 65, the pressure of the primary transfer roller 65, the bias voltage applied from the voltage source 364 or the like are preferably substantially the same as those in the actual image forming apparatus.

In these devices, the value of the resistance can be obtained by dividing the bias voltage applied from the voltage source 264 or 364 by the current measured by the ammeter 265 or 365.

In another example, as shown in FIG. 2, the use is made with the primary transfer roller 65 in place of the electroconductive roller 263, and the electric current flowing through the ammeter 265 with the intermediary transfer belt 61 trained, by which a combined resistance of the intermediary transfer belt 61 and the primary transfer roller 65 is obtained, and the current flowing through the ammeter 265 with the intermediary transfer belt 61 not trained, by which the resistance of the primary transfer roller 65 alone is obtained, and the resistance of the intermediary transfer belt 61 is obtained by deduction of the resistance of the primary transfer roller 65 from the combined resistance of the intermediary transfer belt 61 and the primary transfer roller 65. This method is advantageous since the resistances of both elements can be measured by one device.

FIG. 4 shows the results of the investigations of the abnormal electric discharge when the resistances of the intermediary transfer belt 61 and the primary transfer roller 65 are changed. The resistances were measured using the apparatuses described in conjunction with FIGS. 2 and 3 under 23° C.50% Rh ambience. The moving speed of the intermediary transfer belt 61 was 100 mm/sec, the width of the intermediary transfer belt 61 was 250 mm, the widths of the primary transfer roller 65 and the electroconductive roller 263 were 220 mm, the pressure by the primary transfer roller 65 was 400 gf, similarly to those of the actual image forming apparatus.

The used image patterns were a monochromatic solid image, a half-tone image (600 dpi, basic pixel 3 dots×3 dots matrix, 200 dpi half-tone), a lateral line image of 2 dots 3 spaces, and a solid two-color image.

As shown in FIG. 4, when the resistance Rb of the intermediary transfer belt 61 is not less than $2\times10^9\Omega$, images with abnormal discharge are observed in the solid image, the half-tone image, the 2 dot 3 space image irrespective of the resistance Rt of the primary transfer roller 65. When the resistance Rb of the intermediary transfer belt 61 is between $1\times10^6\Omega$ and $1\times10^9\Omega$, the occurrence of the abnormal discharge image is dependent on the resistance Rt of the primary transfer roller 65. When Rt/Rb<1.0, the abnormal image is not observed in the case of the solid image, but the abnormal discharge images are observed in the half-tone image and 2 dot 3 space image, as indicated by "X" in the Figure. When Rt/Rb=1.0, the abnormal image is not produced in the solid image and the half-tone image, but the abnormal image are slightly observed (not a problematic level) in the 2 dot 3 space image. This is indicated by triangles in the Figure. When Rt/Rb>1.0, no abnormal image was observed in any types of the images.

However, when the resistance Rt of the primary transfer roller 65 is not less than $1\times10^{10}\Omega$, the transferring current is not sufficient, so that solid image of superimposed two color images is not satisfactorily transferred with the result of density insufficiency (indicated by "-" in the Figure).

As described in the foregoing, by satisfying Rt/Rb≧1.0, the generation of the abnormal discharge image can be effectively prevented. The reasons will be as follows.

The transferring current flows from the primary transfer roller 65 through the intermediary transfer belt 61 to the photosensitive drum 1. When the current locally concentrates, the current tends to be suppressed by the function of the voltage drop through the resistances of the primary transfer roller 65 and the intermediary transfer belt 61. When Rt/Rb<1.0, the resistance of the intermediary transfer belt 61 is dominant in the current suppression function. However, since the suppression by the resistance of the intermediary transfer belt 61 begins only after start of the discharge caused by the local concentration of the current between the photosensitive drum 1 and the intermediary transfer belt 61, the generation per se of the abnormal image is unavoidable. When Rt/Rb≧1.0, the resistance of the primary transfer roller 65 is dominant in the current suppression function. Since the suppression by the resistance of the primary transfer roller 65 is effected within the primary transfer roller 65, the discharge per se due to the local current concentration between the photosensitive drum 1 and the intermediary transfer belt 61, and therefore, the generation of the abnormal image can be prevented.

As described above, by satisfying the ratio between the primary transfer belt resistance Rt to the intermediary transfer belt resistance, Rb Rt/Rb≧1.0, the abnormal image attributable to the local current concentration can be prevented.

The description will be made as to an image forming apparatus according to a second embodiment of the present invention. FIGS. 5(*a*), 5(*b*), 6(*a*), and 6(*b*) show resistance values of the primary transfer roller under different ambient conditions. FIGS. 7(*a*), 7(*b*), 8(*a*), and 8(*b*) show relations between the ambience resistance property and resistance ratio Rt/Rb. The same reference numerals as in Embodiment 1 are assigned to the elements having the corresponding functions in this embodiment, and the detailed description thereof is omitted for simplicity.

In the first embodiment, it has been described that by satisfying the ratio Rt/Rb between resistance Rt the primary transfer roller 65 and the resistance Rb of the intermediary transfer belt 61 being Rt/Rb≧1.0, the abnormal electric discharge can be prevented. In the second embodiment, the relation is maintained over the ambient conditions under which the image forming apparatus is operated, so that occurrence of the abnormal image can be prevented respective of the change in the ambient conditions.

FIGS. 5(*a*), 5(*b*), 6(*a*), and 6(*b*) show the values of resistances of the primary transfer roller 65 and the intermediary transfer belt 61 under different ambient conditions. The abscissa represents the ambient condition including the low temperature/low humidity ambience (10° C.15% Rh), the normal temperature/normal humidity ambience (23° C.50% Rh) and the high temperature/high humidity ambience (30° C.80% Rh). The ordinate represents the resistances measured through the method which has been described with respect to the first embodiment. FIGS. 5(*a*) and 5(*b*) show the resistances of the primary transfer roller 65 (A1, A2, and FIGS. 6(*a*) and 6(*b*) show the resistances of the intermediary transfer belt 61 (B1, B2).

The primary transfer rollers A1, A2, and the intermediary transfer belts B1, B2 are made of the following materials.

Primary transfer roller A1: a mixture of NBR rubber and epichlorohydrin rubber which exhibits ionic electroconductivity, and the resistance thereof can be adjusted by the mixing ratio.

Primary transfer roller A2: EPDM rubber in which carbon black and/or metal oxide are dispersed as resistance adjustment material. This material exhibits electronic electroconductive type conductivity, and the resistance can be adjusted by changing the amount of dispersed carbon black and/or metal oxide.

Intermediary transfer belt B1: PVDF resin material added with ion electroconductive resin material. This material exhibits ionic type electroconductivity, and the resistance can be adjusted by changing the amount of additive of the ion electroconductive resin material.

Intermediary transfer belt B2: PVDF resin material in which carbon black or metal oxide is dispersed. This material exhibits electronic electroconductive type conductivity, and the resistance can be adjusted by changing the amount of dispersed carbon black and/or metal oxide.

As will be understood from these Figures, the variation amount and tendency of the value of the resistances depending on the time in conditions are significantly influenced by the electroconductive material of the intermediary transfer belt 61 and the primary transfer roller 65. Generally, the ionic electroconductive material exhibits a resistance which is dependent on the amount of water in the ambience, that is, the resistance is low and other high temperature and high humidity conditions, and the resistance is high under the low temperature and low humidity conditions (FIG. 5(*a*); FIG. 6(*a*)).

The electronic electroconductive type material exhibits of resistance which is immune to the amount of water in the ambience, but the resistance is high under a high temperature conditions, and the resistance is low under the low temperature conditions (FIG. 5, (*b*); FIG. 6, (*b*)). This will be because the distances between the electroconductive material particles increase with increase of the temperature.

The description will be made as to a preferable combination (Embodiment) of the primary transfer roller 65 and the intermediary transfer belt 61 and as to an unpreferable combination (comparison example). As described hereinbefore, the tendencies of variation of the resistances of the primary transfer roller 65 and the intermediary transfer belt 61 depending on the ambient conditions are different if the material of the electroconductive material thereof is different. In view of these, is preferable that tendencies are made equivalent.

Embodiment 1: Primary Transfer Roller A1 and Intermediary Transfer Belt B1

FIG. 7(*a*) shows the ambience dependency of resistance and the resistance ratio Rt/Rb. They have the ionic electroconductivity. As will be understood from the Figure, both of the resistances are low under the high temperature and high humidity conditions, and high under the low temperature and low humidity. Thus, the tendencies of the ambience dependency of resistance are the same with each other, and the resistance ratio Rt/Rb is 1.3–8.0, that is, it is not less than 1.0 respective of the ambient conditions (the values of the Rt/Rb are indicated at the right side of each of the graphs).

Embodiment 1: Primary Transfer Roller A2 and Intermediary Transfer Belt B2

FIG. 7(*b*) shows the ambience dependency of resistance and the resistance ratio Rt/Rb. They have electronic electroconductivity. As will be understood from the Figure, the resistance is high under the high-temperature conditions, and is low under the low-temperature conditions. Thus, the resistances exhibit the same tendencies of ambience dependency of resistance, and the resistance ratio Rt/Rb is 2.4–2.6, that is, it is not less than 1.0 respective of the ambient conditions.

Comparison Example 1

Primary Transfer Roller A1 and Intermediary Transfer Belt B2

FIG. 8(*a*) shows the ambience dependency of resistance and the resistance ratio Rt/Rb. The primary transfer roller 65 exhibits ionic electroconductivity, and the intermediary transfer belt 61 exhibits electronic electroconductivity. The resistance of the primary transfer roller 65 is low under the high temperature and high humidity conditions, and is high under the low temperature and low humidity conditions. On the other hand, the resistance of the intermediary transfer belt 61 is high and other high-temperature conditions, and is low under the low temperature conditions. As a result, the resistance ratio Rt/s Rb are 14.7 and 2.5 under the low temperature and low humidity ambience conditions and normal temperature and normal humidity ambience, respectively, that is, they are not less than 1.0 under these conditions. However, under the high temperature and high humidity ambience, they are 0.4 which is not more than 1.0.

Comparison Example 2

Primary Transfer Roller A2 and Intermediary Transfer Belt B2

FIG. 8(*b*) shows the ambience dependency of resistance and the resistance ratio Rt/Rb. The primary transfer roller exhibits electronic electroconductivity, and the intermediary transfer belt 61 exhibits ionic electroconductivity. Therefore, the resistance of the primary transfer roller 65 is high under the high-temperature conditions and is low under the low temperature conditions. On the other hand, the resistance of the intermediary transfer belt 61 is low under the high temperature and high humidity and is high under the low temperature and low humidity conditions. As a result, the resistance ratio Rt/s Rb are 44.0 and 2.5 under the high temperature and high humidity ambience conditions and normal temperature normal humidity ambience conditions, respectively, which are not less than 1.0. However, under the low temperature and low humidity ambience conditions, they are 0.2 which is not more than 1.0.

The produced images produced by the apparatuses of the embodiments and comparison examples were checked. With the apparatus of the embodiments, no abnormal discharge image is observed under any ambient conditions. With the apparatus of the comparison examples, under the conditions where resistance ratio Rt/Rb$\geqq$1.0, no abnormal discharge image is produced, but under the conditions where Rt/Rb<1.0, the abnormal discharge image occurs.

The adjustable range of the resistance of the primary transfer roller 65 or the intermediary transfer belt 61 is determined by the property of the material thereof. In addition, the resistance changes not only by the ambient conditions but also by the content of dispersed electroconductive material and variation of the dispersing state during manufacturing. Therefore, the transfer roller 65 and the intermediary transfer belt 61 are preferably manufactured in consideration of these factors. If the ambience dependencies of resistance of the primary transfer roller 65 and the intermediary transfer belt 61 are different from each other as with the comprising examples, the selection of the materials and the selection of the products depending on the resistance values are required with the result of cost increases. On the other hand, according to embodiments of the present invention, the difference in the ambience dependency of resistance is small, and therefore, the selectable range of the material is wide, and the selection of resistance value after the manufacturing is not required, and therefore, the cost increase can be avoided.

Additionally, since the intermediary transfer belt and the primary transfer roller exhibit the same tendency of resistance variation in response to the variation in the ambient condition because of the ionic electroconductivity material used both for the intermediary transfer belt and the primary transfer roller, the optimum transferring current can be easily set, so that structure of the apparatus can be simplified.

Figure 9:
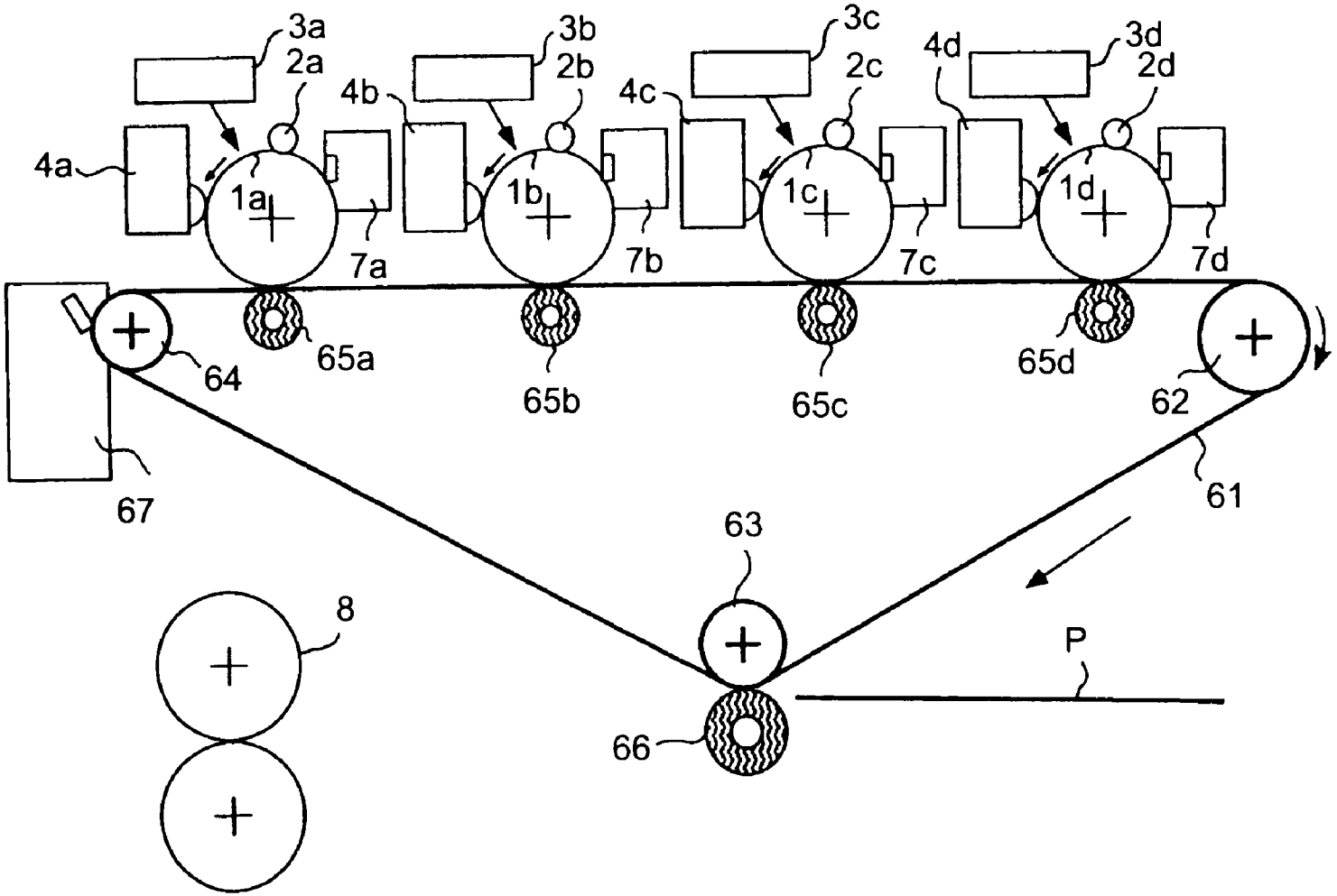
FIG. 9 illustrates an image forming apparatus according to another embodiment of the present invention.
Figure 11:
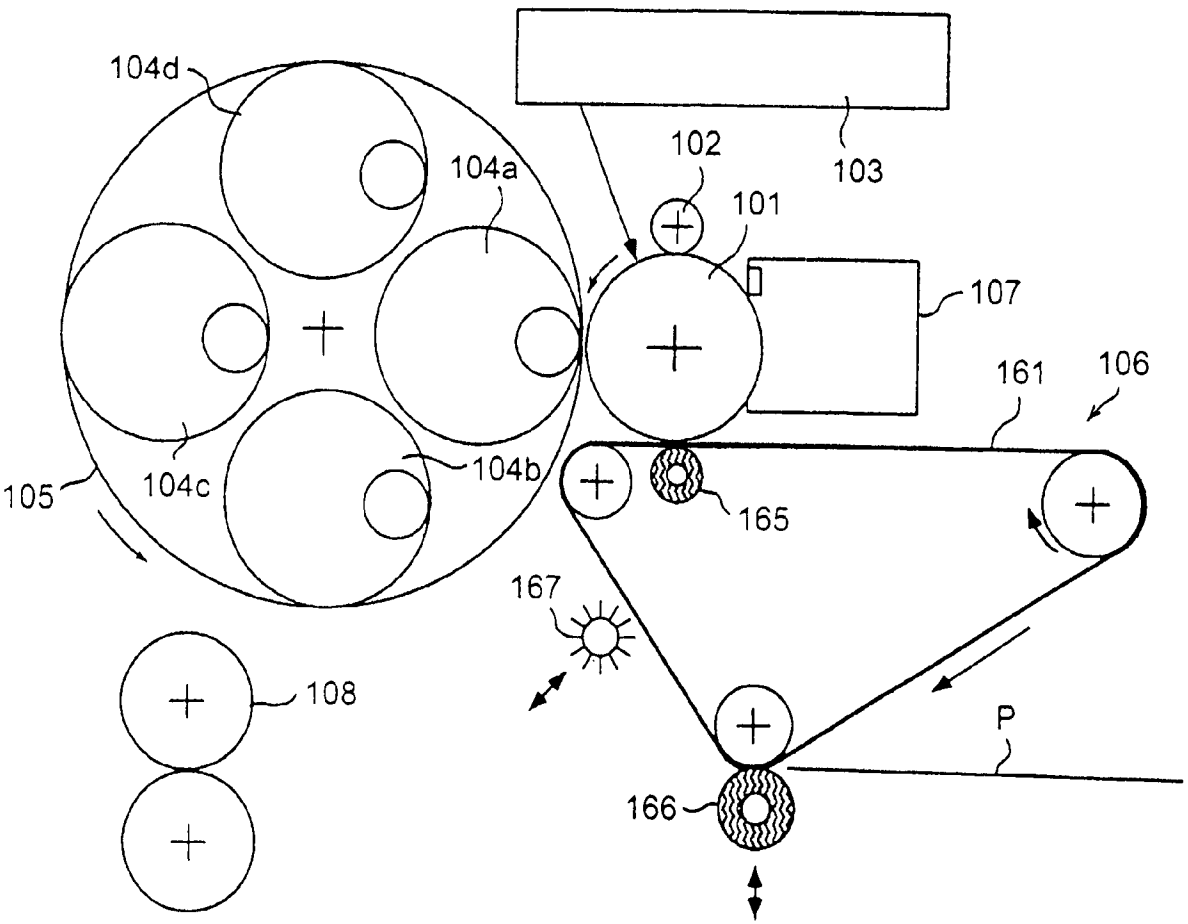
FIG. 11 PRIOR ART
FIG. 11 shows a conventional image forming apparatus.

Referring to FIG. 9, an image forming apparatus according to a third embodiment will be described. FIG. 9 shows a general arrangement of the image forming apparatus according to the third embodiment of the present invention. FIG. 10 shows results of investigation of abnormal electric discharge with different resistance values of the intermediary transfer belt and the primary transfer roller. The same reference numerals as in Embodiment 1 are assigned to the elements having the corresponding functions in this embodiment, and the detailed description thereof is omitted for simplicity.

The image forming apparatus shown in FIG. 9 is a so-called tandem type color image forming apparatus wherein a plurality of image forming station are disposed along the transfer belt 61. The photosensitive drum 1*a–d* is uniformly charged by the charging rollers 2*a–d*, and thereafter, it is exposed to image pattern by exposure devices 3*a–d* in synchronism with the movement of the transfer belt 61, by which latent images are formed on the respective photosensitive drums 1*a–d*. The latent images thus formed are development by developing devices 4*a–d* into visualize toner images, which are superimposedly transferred onto an intermediary transfer belt 61 by respective primary transfer rollers 65*a–d*.

The toner images of different colors transferred onto the transfer belt 61 is all together transferred by a secondary transfer roller 66 onto a sheet P fed in synchronism with the transfer belt 61. The sheet P now having transferred four-color toner image is heated and pressed by the fixing device 8 so that four-color toner image is fused and fixed into a color image.

The untransferred toner on the photosensitive drums 1*a–d* are removed by blade means of the respective cleaning devices 7*a–d*. The untransferred toner on the transfer belt 61 is removed by a cleaning device 67.

In the above-described image forming apparatus, ratios Rta/Rb, Rib/Rb, etc/Rb, Rad/Rb of resistances Rt of the primary transfer rollers 65*a–d* (Rta, Rib, etc, Rad) and a resistance Rb of the intermediary transfer belt 61 are made not less than 1.0, by which abnormal electric discharge in the respective primary transfer portions and therefore occurrence of abnormal image can be avoided.

FIG. 10 shows a relation between the image and the resistances Rt of the primary transfer rollers 65*a–d*, the resistance Rb of the intermediary transfer belt 61 and the ratio therebetween. As regards the same results as with those shown in FIG. 4, the description is omitted by using the same signs for simplicity. What is different here is that when the resistance of the intermediary transfer belt 61 is not more than $1\times10^6\Omega$, the resistance of the intermediary transfer belt 61 is so low that primary transferring current flow to another primary transfer portion through the intermediary transfer belt 61, with the result that primary transfer bias is not properly applied, and transfer defect occurs ("star sign" in the Figure). The resistance Rb of the intermediary transfer belt 61 in this embodiment was $2\times10^6$-$1\times10^9\Omega$.

Particularly, in the tandem type color image forming apparatus as in this embodiment wherein a plurality of primary transfer rollers are used, the wider latitude of material selection and unnecessity of the selection by resistance value is more advantageous.

As described in the foregoing, according to the embodiments of the image forming apparatus of the present invention, the ratio Rt/Rb of the resistance Rt of the transfer member and the resistance Rb of the image bearing member satisfies $Rt/Rb \geqq 1.0$, so that abnormal discharge image can be prevented irrespective of the image pattern.

In addition, the combination of the materials of the transfer member and the image bearing member is so selected that variations of the resistance Rt and the resistance Rb depending on the ambient condition changes exhibit the same tendencies, and the resistance ratio relation of $Rt/Rb \geqq 1.0$ is maintained under different ambient conditions, by which the abnormal discharge image can be avoided under wider range of ambient conditions. Particularly, when the tendencies of the variations of the resistance values of the transfer member and the image bearing member are the same with respect to the change in the temperature/humidity, the selection latitude of the material is wide, and the selection of the resistance in the products can be avoided.

In a so-called tandem type color image forming apparatus wherein a plurality of image forming stations are disposed around the intermediary transfer belt, the abnormal discharge image can be similarly avoided irrespective of the image pattern by the resistance Rt of the transfer member and the resistance Rb of the image bearing member satisfying the ratio $Rt/Rb \geqq 1.0$, and in addition, the advantages are particularly significant in view of the fact that plurality of transfer members are required in such a type of apparatus.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

a first image bearing member for bearing a toner image;

a second image bearing member for bearing the toner image; and a transfer member opposed to said first image bearing member with said second image bearing member therebetween, wherein a voltage is applied to said transfer member to transfer the toner image from said first image bearing member onto said second image bearing member, and wherein a resistance Rt of said transfer member and a resistance Rb of said second image bearing member change with a same tendency in response to a change in an ambient condition, and the resistance Rt of said transfer member and the resistance Rb of said second image bearing member satisfy $Rt/Rb \geqq 1.0$.

2. An apparatus according to claim 1, wherein SAID transfer member and said second image bearing member have ionic electroconductivities.

3. An apparatus according to claim 1, wherein said transfer member and said second image bearing member have electronic electroconductivities.

4. An apparatus according to claim 1, wherein said first image bearing member is a photosensitive member, and said second image bearing member is an intermediary transfer member.

5. An apparatus according to claim 1, wherein SAID second image bearing member is in the form of a belt.

6. An apparatus according to claim 1, wherein the ambient condition includes temperature and humidity conditions.

* * * * *

UNITED STATES PATENT AND TRADEMARK OFFICE

CERTIFICATE OF CORRECTION

PATENT NO. : 6,963,716 B2
DATED : November 8, 2005
INVENTOR(S) : Tatsuya Kobayashi et al.

It is certified that error appears in the above-identified patent and that said Letters Patent is hereby corrected as shown below:

Column 1,
Line 64, “includes” should read -- that includes --.

Column 2,
Line 8, “includes” should read -- that includes --.

Column 3,
Line 20, “(polyb-” should read -- polyc- --; and
Line 24, “(ethyleneterrafluoroethylene” should read -- ethylenetraflouroethylene --.

Column 4,
Line 17, “to” should read -- too --; and
Line 36, “which should be deleted.

Column 5,
Line 60, “are” should read -- is --.

Column 6,
Line 44, “resistance R’” should read -- resistance R of --; and
Line 63, “(A1,A2,” should read -- A1, A2), --.

Column 7,
Line 28, “and other” should read -- under --;
Line 32, “of” should read -- a --.
Line 34, “a” should read -- the --; and
Line 47, “of these, is preferable” should read -- thereof, it is preferable --.

Column 8,
Line 18, “and other” should read -- under --;
Line 45, “temperature normal” should read -- temperature and normal --; and
Line 49, “produced” (first occurrence) should be deleted.

Column 9,
Line 31, “station” should read -- stations --.

UNITED STATES PATENT AND TRADEMARK OFFICE

CERTIFICATE OF CORRECTION

PATENT NO. : 6,963,716 B2
DATED : November 8, 2005
INVENTOR(S) : Tatsuya Kobayashi et al.

It is certified that error appears in the above-identified patent and that said Letters Patent is hereby corrected as shown below:

Column 10,
Line 65, "SAID" should read -- said --.

Column 12,
Line 1, "SAID" should read -- said --.

Signed and Sealed this

Eleventh Day of April, 2006

JON W. DUDAS
*Director of the United States Patent and Trademark Office*